US005235394A

United States Patent [19]

Mills, III et al.

[11] Patent Number: 5,235,394

[45] Date of Patent: Aug. 10, 1993

[54] PUSH-PULL WICKING DEVICE FOR FIXING ROLLER

[75] Inventors: Borden H. Mills, III, Webster; Michael K. Baskin, Rochester, both of N.Y.

[73] Assignee: Eastman Kodak Company, Rochester, N.Y.

[21] Appl. No.: 939,226

[22] Filed: Sep. 2, 1992

[51] Int. Cl.[5] ..... G03G 15/20

[52] U.S. Cl. ..... 355/284; 118/260

[58] Field of Search ..... 355/282, 284, 285; 118/60, DIG. 1, 258, 259, 260, 262; 266/102; 29/110, 116.1, 125, 130

[56] References Cited

U.S. PATENT DOCUMENTS

| | | | |
|---|---|---|---|
| 3,638,459 | 2/1972 | Zimmer | 118/262 X |
| 3,964,431 | 6/1976 | Namiki | 118/60 |
| 4,770,909 | 9/1988 | McIntyre | 427/428 |
| 4,908,670 | 3/1990 | Ndebi | 355/284 |
| 4,989,509 | 2/1991 | Zimmer | 118/262 X |
| 4,994,862 | 2/1991 | Hoover | 355/284 |
| 5,043,768 | 8/1991 | Baruch | 355/284 |
| 5,045,889 | 9/1991 | Hoover | 355/284 |

FOREIGN PATENT DOCUMENTS

| | | | |
|---|---|---|---|
| 0100873 | 6/1983 | Japan | 355/284 |
| 0172063 | 9/1985 | Japan | 355/284 |
| 0174786 | 7/1987 | Japan | 355/284 |

*Primary Examiner*—Leo P. Picard
*Assistant Examiner*—Christopher Horgan
*Attorney, Agent, or Firm*—Leonard W. Treash, Jr.

[57] ABSTRACT

A wicking device for applying toner release oil to the surface of a fuser roller of a reproduction apparatus. The wicking device includes a first rotatable roller that has a hollow interior and a porous capillary shell for pulling toner release oil from the hollow interior to the outside surface thereof. The wicking device also includes a second rotatable roller that is mounted within, and for rotation against, the surface of the hollow interior of the first rotatable roller for supplying and pushing toner release oil into the capillary shell of the first rotatable roller.

13 Claims, 5 Drawing Sheets

PUSH-PULL WICKING DEVICE FOR FIXING ROLLER

BACKGROUND OF THE INVENTION

1. Technical Field

This invention relates to fuser and pressure roller-type fixing apparatus for fixing images in electrostatographic reproduction machines. More particularly, this invention relates to a wicking device for applying image release liquid to the surface of a roller of such a fixing apparatus.

2. Background Art

Fuser and pressure roller-type fixing apparatus are well known for fusing and fixing toner images on suitable receiver sheets in electrostatographic copiers and printers. Usually, the fuser roller of such a fixing apparatus is heated, and is mounted in rotatable nip-forming contact with a pressure roller. Receiver sheets carrying unfused toner images are passed through the formed nip such that the toner images directly contact the fuser roller. A common problem associated with such fixing apparatus is an undesirable offsetting of the toner making up images being fixed from the receiver sheets onto the surface of the fuser roller.

The toner offsetting to the fuser roller can undesirably transfer to subsequent copies or images being fixed, and to the backside of such copies by way of a nip-forming pressure roller.

In order to prevent such offsetting of the toner images, it is known to apply an image-release liquid, such as silicone oil, to the surface of the fuser roller. As disclosed for example in U.S. Pat. No. 4,908,670 issued to Sylvain L. Ndebi on Mar. 13, 1990, and U.S. Pat. No. 5,043,768 issued to Susan C. Baruch on Aug. 27, 1991, it is known to use a rotatable wicking device for applying the release liquid or oil to the fuser roller surface.

Typically, such a rotatable wicking device includes a rotatable roller that is made from a porous or capillary material, and a liquid or oil distribution tube that is located inside the porous roller. Oil transported from a container to the distribution tube flows through small holes in the distribution tube to saturate the interior surface of the porous roller. The oil is then "pulled" by capillary action of the porous roller from the interior of the porous roller (through pores) to the exterior surface thereof for application to a fuser roller surface.

Ordinarily, the oil flows as droplets through a number (5 to 20) of the small holes in the distribution tube. The droplets then drop under gravity onto the interior surface of the rotatable porous roller for covering a group of pores therein. Capillary flow is then relied upon to pull and distribute oil from the covered pores to the rest of the porous roller in a circumferential direction as well as in a radial direction of the porous roller.

Unfortunately, however, the dropwise supply of oil is random from the distribution tube to the interior surface of the porous roller. Accordingly, the complete covering or saturation of pores therein (which is necessary for capillary flow) is also random. Capillary flow of oil to the surface of the porous roller will therefore also be random until a steady state saturation of the interior surface is reached. Ordinarily, it may take the fixing apparatus fixing 3000 to 5000 image-bearing substrates or copies before such a steady-state condition is reached. The result until then, of course, is poor oiling of the fuser roller surface with increased possibility of undesirable image offset and copy sheet jams.

Additionally, when the fixing apparatus is stopped and the porous roller is no longer applying release oil to the fuser roller, release oil in the porous roller will gravitationally settle to a bottom or lower side of the porous roller to form a "puddle". Due to gravity and capillary flow, the "puddle" further settles downward through the pores of the lower portion of the porous roller. The result is an overly saturated portion of the porous roller. Subsequently, such an overly saturated portion then undesirably causes non-uniform and heavily oiled streaks on the surface of a fuser roller being oiled. Image-bearing substrates fixed at a fixing apparatus including such a fuser roller are therefore likely to contain oil induced defects.

SUMMARY OF THE INVENTION

It is an object of the present invention to provide a wicking device for applying image release oil in a fast and uniform manner to the surface of a fuser roller.

It is another object of the present invention to provide a wicking device for applying image release oil to the surface of a fuser roller with substantially no risk of oversaturation streaks on the fuser roller.

In accordance with the present invention, a wicking device is provided for applying release oil to the surface of a fuser roller of a reproduction apparatus. The wicking device includes a first rotatable roller for contacting the surface of the fuser roller. The first rotatable roller has a hollow interior and a porous capillary shell for pulling release oil from the interior to the surface thereof. The wicking device also includes a second rotatable roller that is mounted within, and for rotation against, the surface of the hollow interior of the first rotatable roller for supplying and pushing release oil into the capillary shell of the first rotatable roller.

BRIEF DESCRIPTION OF THE DRAWINGS

In the detailed description of the invention presented below, reference is made to the drawings, in which.

DETAILED DESCRIPTION OF THE INVENTION

Figure 1:
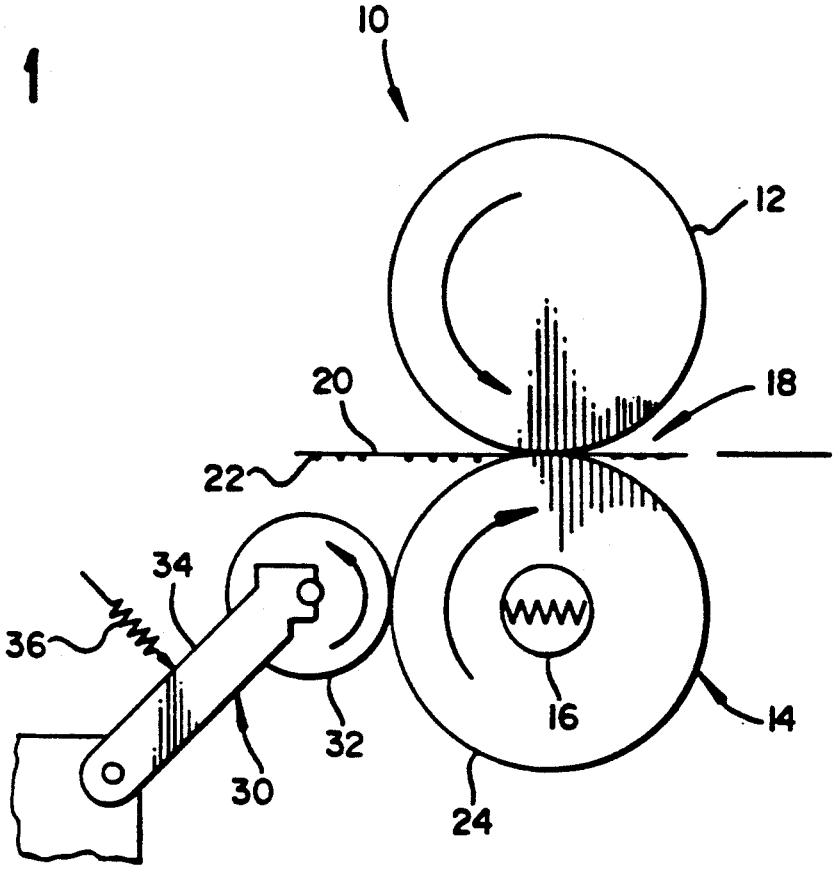
FIG. 1 is a schematic end view of a fixing apparatus in which the wicking device of the present invention is useful.

Referring now to the drawings, a fuser and pressure roller type fixing apparatus, such as are used in an electrostatographic reproduction machine, is designated generally by the reference numeral 10. As shown, the fixing apparatus 10 includes a rotatable pressure roller 12, and a rotatable fuser roller 14 that is heated by means such as a quartz lamp 16. Pressure roller 12 and heated fuser roller 14 form a fusing nip 18 through which a substrate or receiver sheet 20 carrying unfused toner images 22 is passed for fusing and fixing such images 22 to the receiver sheet 20. The receiver sheet 20 is passed through the fusing nip 18 such that the toner images 22 directly contact the surface 24 of rotatable fuser roller 14. Ordinarily, the quality of the fixed images exiting the fusing nip 18 on the receiver sheet 20 depends in significant part on the toner images 22 not offsetting, during fusing and fixing, from the sheet 20 onto the surface 24 of fuser roller 14.

Accordingly, in order to prevent the toner images 22 from offsetting onto the fuser roller 14, the fixing apparatus 10 includes the wicking device of the present invention, designated generally as 30, for applying a toner release liquid or oil to the surface 24 of fuser roller 14. The wicking device 30 includes a wicking roller assembly 32, and a holding member 34 that is urged towards or loaded against the fuser roller 14 for example by spring means 36.

Figure 2:
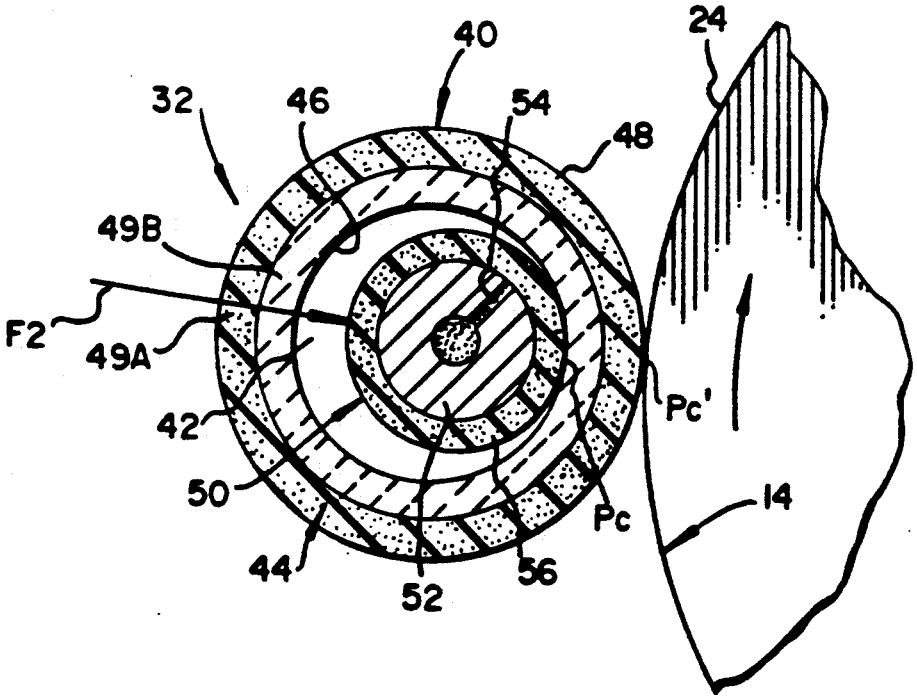
FIG. 2 is a cross-sectional view of a first embodiment of the wicking device of the present invention loaded against a fuser roller.
Figure 3:
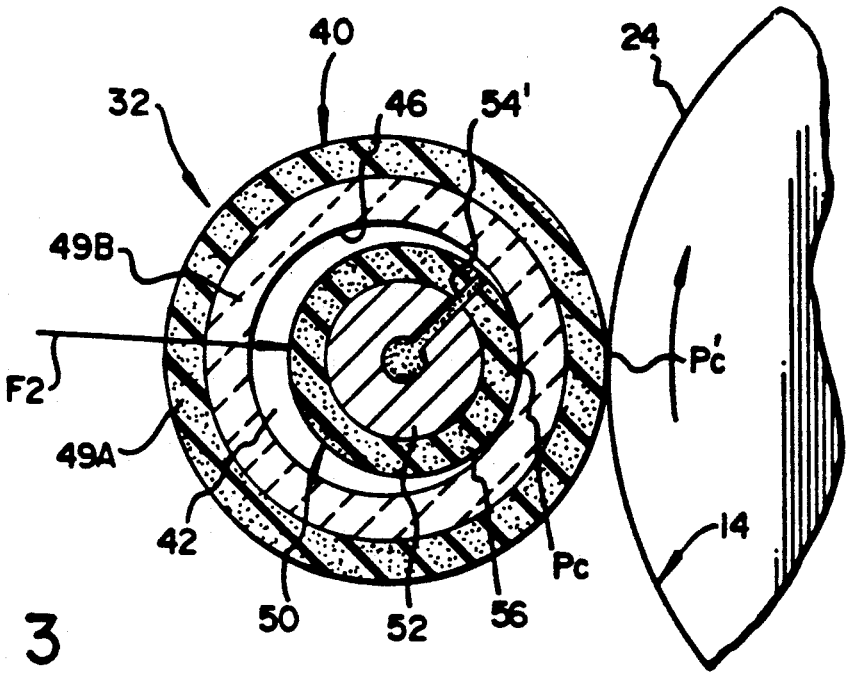
FIG. 3 is a cross-sectional view of a second embodiment of the wicking apparatus of the present invention loaded against a fuser roller.

Referring now to FIGS. 2 and 3, the wicking roller assembly 32 includes a first rotatable roller 40 that contacts the surface 24 of fuser roller 14, and that is frictionally rotated by movement of the surface 24 for applying release oil to the surface 24. The first rotatable roller 40 has a hollow interior 42 and a shell or layered portion 44 that defines the hollow interior. The layered portion 44 is made of a porous or capillary material, such as ceramic or a fabric, so as to be able to pull release oil from its interior surface 46 to its outer surface 48. As shown, the shell or layered portion 44 of first roller 40 may comprise an inner porous ceramic layer 49B for rigidity, and an outer capillary fabric layer 49A made for example from NOMEX (trademark of Du-Pont).

The wicking roller assembly 32 further includes a second rotatable roller 50 that is mounted for rotation within the hollow interior 42 as well as out of phase relative to the rotation of the interior surface 46 of the first rotatable roller 40. The second roller 50 is mounted, as such, for supplying and pushing release oil into the interior surface 46 of the shell 44 of first roller 40. The second roller 50 includes a feed tube 52 through which release oil is fed under pressure, into the wicking roller assembly 32. In a first embodiment, as shown in FIG. 2, the feed tube 52 has at least an axially extending hole or slit 54 through which oil flows from the tube 52. As shown, the second roller 50 also includes an outside layer 56 which is made of a conformable and porous material and which fits over the feed tube 52 completely or substantially enclosing the feed tube 52. Alternatively, in a second embodiment as shown in FIG. 3, an axially extending hole or slit 54' may be formed both through the feed tube 52 and through the enclosing conformable material of the outside layer 56. This embodiment allows direct drop-by-drop oil application through the hole 54' to the interior surface 46.

As shown, the hollow interior 42 of first rotatable roller 40 is generally cylindrical and is made large enough so as to have a diameter that is substantially greater than the outer diameter of second rotatable roller 50. As such, the circumferential dimension of the interior surface 46 is therefore also substantially greater than that of the outside layer 56 of second roller 50. Such a difference allows the second rotatable roller 50 to not only rotate within, but out of phase relative to the rotation of the interior surface 46.

Figure 4:
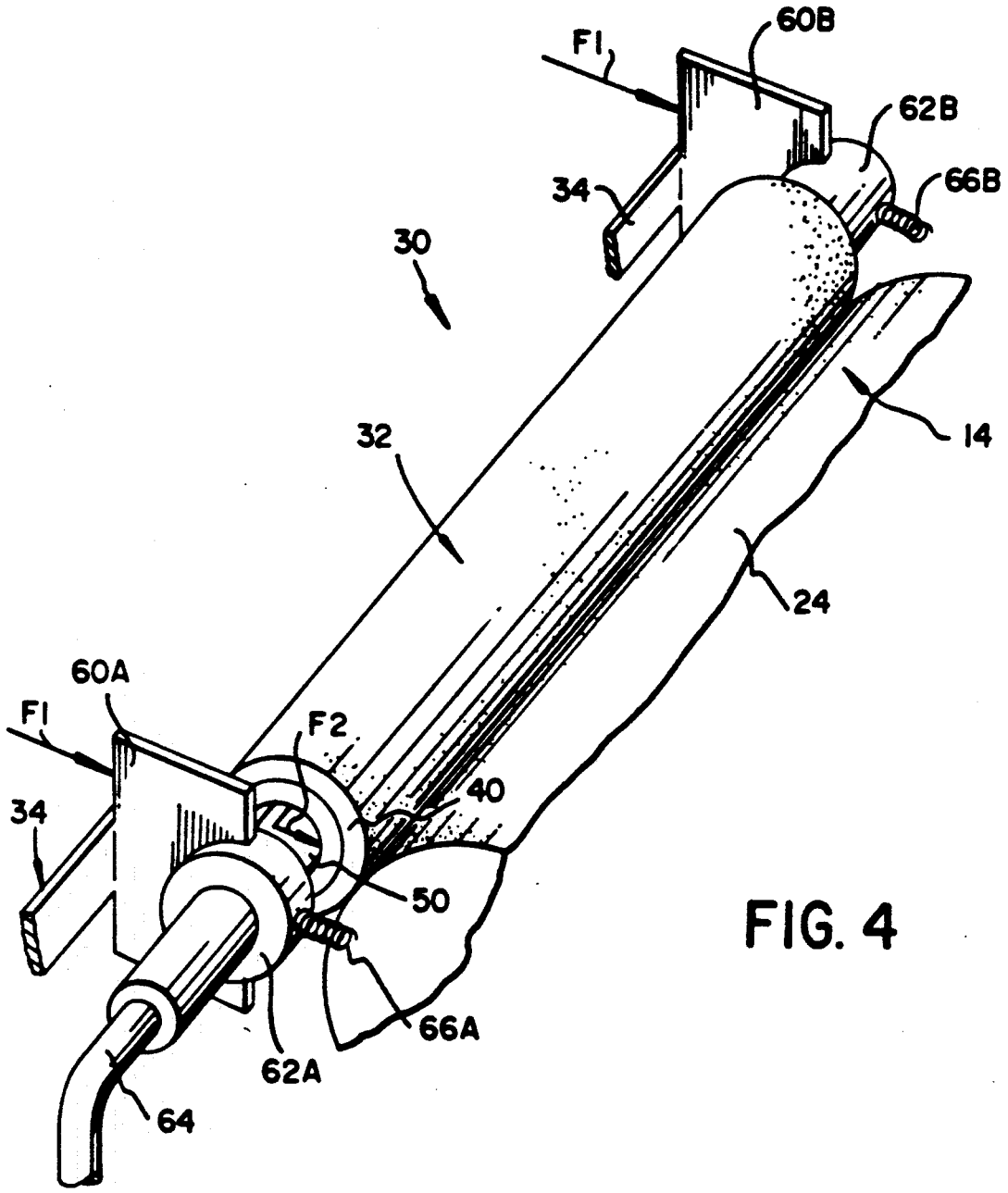
FIG. 4 is a perspective view of the wicking device of the present invention showing mounting and loading means.

Referring now to FIG. 4, the wicking roller assembly 32 is shown mounted for rotation to a pair of mechanical arms 60A, 60B for rotation over end bearings 62A, 62B, respectively. The axis of rotation of the bearings is the same as that of the second roller 50 which is inside the first roller 40. A rotary union 64 allows release oil to flow through to the second rotatable roller 50 inside the first rotatable roller 40.

The mechanical arms 60A, 60B as mounted constrain the wicking roller assembly 32 in five different directions, namely: in both axial directions, in both vertical directions, and in the direction away from the fuser roller 14. As such, the mechanical arms 60A, 60B and the respective holding member 34 for each, are allowed to either translate or rotate towards the fuser roller 14 for transmitting an externally applied loading force $F_1$ (as by the spring member 36 shown in FIG. 1) to the bearings 62A, 62B, respectively, at each end of the mounted wicking roller assembly 32.

The external force $F_1$ can also be generated for example by any suitable means including solenoids or compressed air cylinders associated with the holding member 34, (but only during a running cycle of the fixing apparatus 10, that is, during a period when image-carrying receiver sheets 20 are being fused). This, of course, is when it is necessary to oil the fuser roller 14. The force $F_1$ transmitted to the bearings, for example the bearing 62A, results in a loading force shown as $F_2$ being exerted by the second rotatable roller 50 against the interior surface 46 of the first rotatable roller 40. The loading force $F_2$ thus causes the second roller 50 to contact the interior surface 46 of first roller 40 along a desired line $P_c$ (FIGS. 2 and 3), and to load the shell 44 of the first roller 40 along a corresponding line $P_c'$ (FIGS. 2 and 3) into contact with the fuser roller 14. Retraction springs shown as 66A, 66B can be used for example to unload the wicking assembly 32 from the fuser roller 14 when such oiling of the surface of roller 14 is not necessary.

Figure 5:
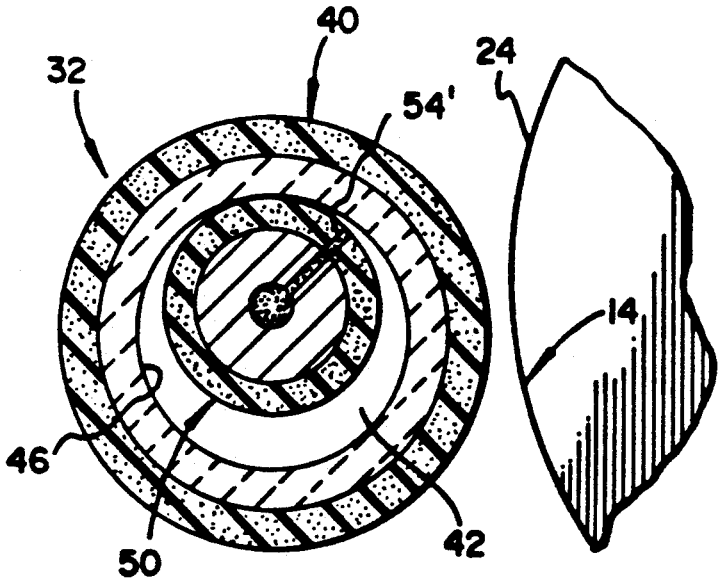
FIG. 5 is a similar view as that of FIG. 3 showing the wicking device of the present invention unloaded from the fuser roller.

As shown in FIG. 5, when the external force $F_1$ is removed from the mechanical arms 60A, 60B, the loading force $F_2$ as a result will no longer be exerted on the second, inner roller 50. Consequently, the springs 66A, 66B will be able to push and space the wicking roller assembly 32 away from the fuser roller 14. The first or outer roller 40 will then merely rest freely under the force of gravity on the inner roller 50, as shown, spaced from the roller 14 until the force $F_1$ is again applied to reload the assembly 32 into contact with the roller 14.

Referring now to FIGS. 6A–6E rotation and operation of the wicking roller assembly 32 is shown through representative angles of rotation of 0°, 90°, 180°, 270° and 360° of the second, inner roller 50. As shown, when loaded by the force $F_2$, the shell 44 of first roller 40 will be loaded and wedged along the line $P_c'$ against the surface 24 of fuser roller 14. As loaded, and because of the size difference of the rollers, the first outer roller 40 has a first axis of rotation $A_1$, and the second inner roller 50 has a second spaced and parallel axis of rotation $A_2$.

Rotation of the fuser roller 14 by suitable means (not shown) in the direction of the arrow 70 frictionally causes the rotatable first roller 40 to rotate about the axis $A_1$ in the direction shown by the arrow 72. Because the interior surface 46 (FIGS. 2 and 3) of the first roller 40 is in frictional contact with the outside surface of the rotatable second roller 50, rotation of the roller 40 also frictionally rotates the second roller 50 about its axis $A_2$, and in the direction shown by the arrow 74. Since the outer surface of the inner roller 50, and the inner surface of the outer roller 40 are different in circumference, the two rollers will have not only different axes of rotation as shown in the FIGS. 6A–6E, but also different angular velocities of rotation.

The pressure in the oil tube 52 is selected such that oil is applied in a dot-by-dot pattern to the inner surface 46 of the first, outer roller 40, and only when the oil holes 54, 54' in the tube 52 and inner roller 50, are in direct and loaded-contact along the line $P_c$ (FIGS. 2 and 3) on such surface 46. Ordinarily, in most conventional reproduction apparatus, the relationship between the surface speed of the fuser roller 14 (being oiled) and a required rate of oil application to such surface is such that no drops of oil need to flow from the tube 52 (and from the inner roller 50) to the surface 46 during the time when the holes 54, 54' are out of contact (FIGS. 6B, 6C and 6D) with such surface 46.

Figure 6A:
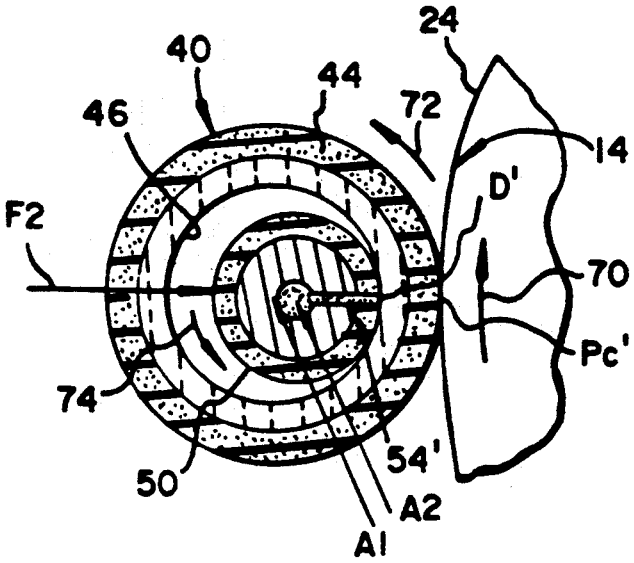
FIGS. 6A–6E are cross-sectional views of the wicking device of FIG. 3, respectively, showing its sequential rotation through 360°.
Figure 6B:
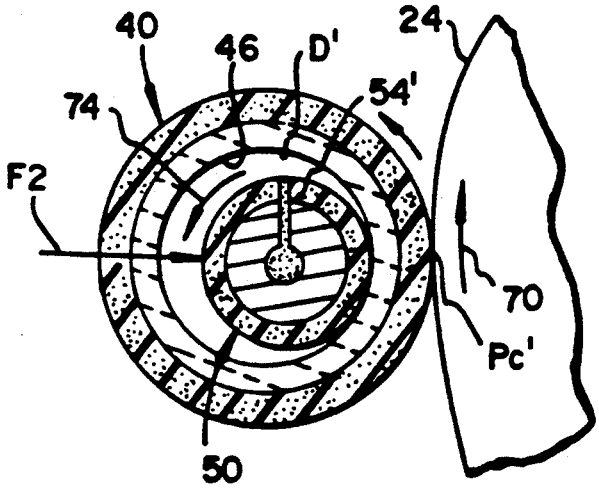
Figure 6C:
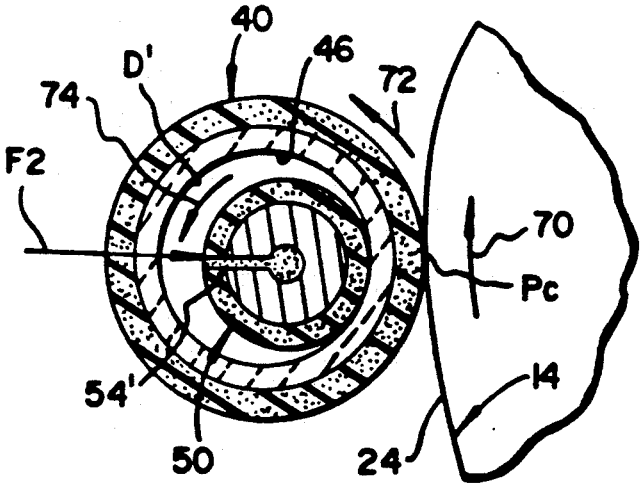
Figure 6D:
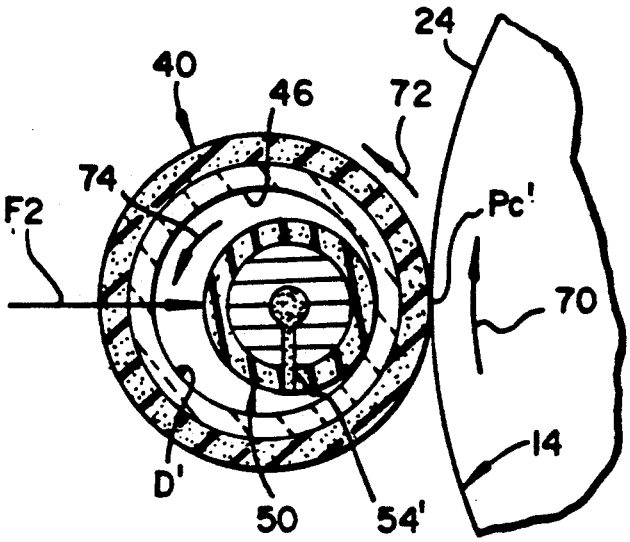
Figure 6E:
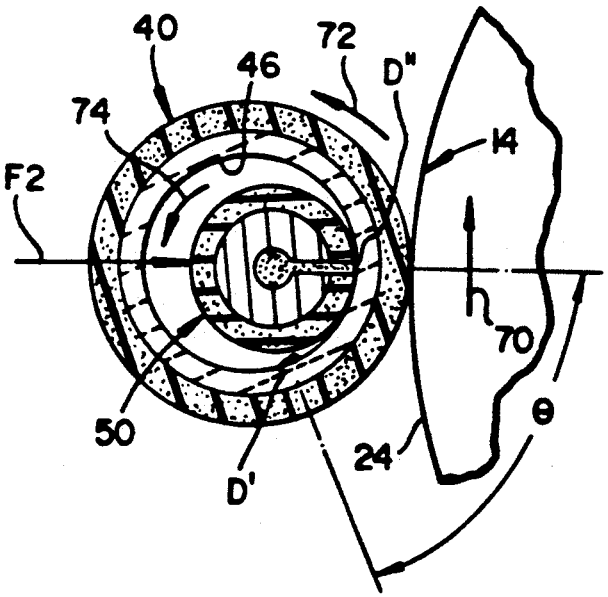

However, at the start up of a completely dry wicking roller assembly 32 following a long, idle or rest period, extra pressure can be selectively applied in order to cause extra oil to flow into and over the inner roller 50 even when the holes 54, 54' are out of contact with the surface 46 until a desired steady state condition. Once such a steady should be cut back again to where oil flow is only effective when the rollers are in the positions as shown in FIGS. 6A and 6E.

A solid dot D' as shown in FIGS. 6A to 6E denotes an initial oil dot that is applied at angle 0° to the surface 46 for example after the wicking assembly 32 has reached steady state. Because the circumferences of the moving outside surface of inner roller 50 and of the moving surface 46 are different, the surface 46 (because it is greater) will rotate at a slower angular velocity (that is, over fewer angular degrees in the same time period) than the inner roller 50. The referenced point for measuring such rotation is the location of the holes 54, 54' therein. Thus, as shown in FIGS. 6A–6E, when the inner roller 50 has completed its first revolution after reaching a steady state condition, the outer roller 40, and hence its inner surface 46, will have completed significantly less than one of its own revolutions. The difference between the two rotations is shown particularly in FIG. 6E by the angle $\theta$.

At the completion of its first revolution (and hence at the start of its second revolution), the inner roller 50 will again deposit or apply a second dot D'' of oil (FIG. 6E) on the surface 46, and at a point that is $\theta$ away from the first dot D'. Again, such a difference in positions between the first dot D' and the second dot D'' is caused by the difference in circumferences between the smaller, inner roller 50, and the surface 46. The wicking roller assembly 32 is designed such that this angular difference $\theta$ results in a pattern that is maintained between a new dot of oil and the dot just before that. The difference in circumferences can be so selected such that 360° is divisible N times (where N is an integer) into the angle $\theta$. As such, a repeatable oil application dot pattern can be achieved in which the N+1 dot being applied is deposited or applied substantially where the initial dot D' was applied, thereby starting the pattern all over again.

In summary, it can be seen that with the wicking device 32 loaded against the fuser roller 14, release oil can be fed under extra pressure through the tube 52 into, through and or over the inner roller 50 for "pushing" by the second inner roller 50 into the inner surface 46 of the shell 44 of the outer roller 40. Such extra pressure can be continued until the shell 44 of outer roller 40 has reached a steady state saturation condition. At the same time oil is being pushed into the shell 44, the porous or capillary material of the shell 44 will be pulling the release oil by capillary action towards its surface for application to the surface 24 of fuser roller 14.

Once the steady state saturation condition is reached, the pressure is controlled such that oil flows from both the tube 52 and inner roller 50, through the holes 54, 54', only when the holes 54, 54' are in direct and loaded contact at point $P_c$ against the surface 46. As such, the wicking device 32 of the present invention can be brought in a fast and controlled manner from a dry state to a steady-stage saturation condition. Additionally, the "pushing and pulling" actions of the wicking device 32 operate to reduce the quantity of oil being held (at saturation) in the shell 44 at any time. Such a reduction in this quantity of oil prevents the formation of "puddles", and hence subsequent oil defects as discussed above.

The invention has been described in detail with particular reference to a presently preferred embodiment, but it will be understood that variations and modifications can be effected within the spirit and scope of the invention.

What is claimed is:

1. A device for applying toner release liquid to a rotatable fuser roller of a reproduction apparatus, the device comprising:

(a) a first rotatable roller for contacting the fuser roller, said first rotatable roller having a hollow interior and a porous capillary shell for pulling oil from said interior to the surface thereof;

(b) a second roller, mounted within said hollow interior of said first rotatable roller, for supplying and pushing toner release oil into said shell of said first rotatable roller, said second roller being rotatable within and out-of-phase relative to said first; and (c) a feed tube for supplying toner release oil to said second rotatable roller, said feed tube being substantially enclosed by said second roller.

2. The device of claim 1 wherein said hollow interior of said first rotatable roller is generally cylindrical, and wherein said second roller has an outer diameter that is less than the inside diameter of said cylindrical hollow interior.

3. The device of claim 2 wherein said first and said second rotatable rollers are mounted so as to have a desired mutual contacting line along which said second roller contacts a portion of an interior surface defining said hollow interior of said first rotatable roller.

4. A toner fixing apparatus including a fuser roller having a fixing surface, and a device for applying toner release oil to said fixing surface, the device comprising:

(a) a first rotatable roller having an outer layer for contacting said fixing surface of the suer roller, and having an inner layer including an inner surface defining a cylindrical hollow interior, said firs rotatable roller being rotatable about a first axis;

(b) a second rotatable roller for distributing toner release oil to said first rotatable roller, said second rotatable roller being mounted within said hollow interior of said first rotatable roller, and said second rotatable roller being rotatable about a second and different axis; and (c) a feed for supplying toner release oil to said second rotatable roller.

5. The device of claim 4 wherein said outer layer of said first rotatable roller comprises a porous capillary material.

6. The device of claim 4 wherein said inner layer of said first rotatable roller comprises a porous ceramic material.

7. The device of claim 4 wherein said second rotatable roller comprises a feed tube, and a porous conformable outside layer substantially enclosing said feed tube.

8. The device of claim 7 wherein said second rotatable roller is mounted such that said outside layer thereof rotatably contacts a portion of an interior surface defining said hollow interior of said first rotatable roller.

9. The device of claim 8 including loading means for urging said second rotatable roller into such contact with said first rotatable roller.

10. The device of claim 9 wherein rotation of said first rotatable roller causes said interior thereof to frictionally rotate said second rotatable roller.

11. The device of claim 10 wherein said second rotatable roller includes an axially extending line of oil supply holes formed through said outside layer.

12. The device of claim 11 wherein said second rotatable roller has an outer diameter that is less than an inner diameter of said cylindrical hollow interior such as to create spaced and circumferentially progressing oiling contacts between said oil supply holes and said interior surface of said first rotatable roller, that are repeated after a predetermined number of revolutions of said second rotatable roller.

13. The device of claim 12 wherein said first rotatable roller is frictionally rotatable by the fuser roller.

* * * * *

UNITED STATES PATENT AND TRADEMARK OFFICE

CERTIFICATE OF CORRECTION

PATENT NO. : 5,235,394

DATED : August 10, 1993

INVENTOR(S) : Borden H. Mills, III, et al

It is certified that error appears in the above-indentified patent and that said Letters Patent is hereby corrected as shown below:

| | | |
|---|---|---|
| Column 6, | line 39, | After "first" insert --roller-- |
| | line 58, | Delete "suer" and substitute --fuser-- |
| | line 60, | Delete "firs" and substitute --first-- |
| | line 68, | After "feed" insert --tube-- |

Signed and Sealed this

Eighth Day of March, 1994

Bruce Lehman

*Attest:*

BRUCE LEHMAN

*Attesting Officer*

*Commissioner of Patents and Trademarks*